United States Patent [19]

Ury et al.

[11] 4,042,850

[45] Aug. 16, 1977

[54] MICROWAVE GENERATED RADIATION APPARATUS

[75] Inventors: Michael Gerson Ury, Bethesda; Bernard John Eastlund, Olney; Ray S. Braden, Gaithersburg; Charles H. Wood, Rockville, all of Md.

[73] Assignee: Fusion Systems Corporation, Rockville, Md.

[21] Appl. No.: 667,759

[22] Filed: Mar. 17, 1976

[51] Int. Cl.[2] ..... H01J 7/46; H01J 19/80

[52] U.S. Cl. ..... 315/39; 315/111.1; 313/231.5; 313/231.6

[58] Field of Search ..... 315/39, 111.1; 313/231.5, 231.6

[56] References Cited

U.S. PATENT DOCUMENTS

| | | | |
|---|---|---|---|
| 3,374,393 | 3/1968 | Bramley | 315/39 |
| 3,577,207 | 5/1971 | Kirjushin | 315/39 |
| 3,609,448 | 9/1971 | Williams | 315/39 |
| 3,641,389 | 2/1972 | Leidigh | 315/39 |
| 3,648,100 | 3/1972 | Goldie et al. | 315/39 |
| 3,914,766 | 10/1975 | Moore | 315/39 |

*Primary Examiner*—Saxfield Chatmon, Jr.
*Attorney, Agent, or Firm*—Martin Abramson

[57] ABSTRACT

An apparatus for efficiently coupling microwave energy to a highly dissipative load such as a plasma lamp tube. A longitudinally extending lamp tube is enclosed in a longitudinally extending non-resonant microwave chamber having a pair of coupling slots therein which are oriented perpendicular to the direction of the lamp tube. The slots are azimuthally offset in opposite directions with respect to a longitudinally extending top center line of the chamber by about 15° to 20°, and are located near respective ends of the chambers but at different distances therefrom. Microwave energy from a pair of microwave energy generating means is coupled to the respective slots with the frequency outputs of the generating means being offset from each other by a small amount.

13 Claims, 5 Drawing Figures

MICROWAVE GENERATED RADIATION APPARATUS

The present invention relates to an apparatus for efficiently coupling microwave power to a dissipative load and is related to the apparatus for generating radiation disclosed in U.S. Pat. No. 3,872,349 which is incorporated herein by reference.

Briefly, U.S. Pat. No. 3,872,349 disclosed a microwave generated plasma light source for emitting radiation in the ultraviolet and visible portions of the spectrum. A plasma forming medium is confined in a longitudinally extending tube which is surrounded along its length by a non-resonant microwave chamber, a portion of which comprises a reflector for the emitted radiation, and a portion of which is transparent to the emitted radiation while being opaque to microwaves. In some embodiments (FIGS. 15 to 20) microwave energy is coupled to the non-resonant chamber through coupling slots.

While the apparatuses disclosed in U.S. Pat. No. 3,872,349 may operate satisfactorily in the commercial and industrial applications for which the light source is intended, in such applications it is imperative to optimize the efficiency and performance of the light source, and it is towards these objects that the present apparatus is directed.

It is particularly important to provide an apparatus in which the generated microwave energy is coupled to the plasma in as efficient a manner as possible. Further, the apparatus must be arranged so that the unionized plasma breaks down electrically and absorbs nearly all of the microwave power within a short time (3 to 6 seconds) after system turn-on. Further, it has been found that for high performance operation, resonances or cavity-like effects must be avoided. These, through geometrical reflections of energy, set up standing waves which result in concentrating microwave field energy and, therefore, plasma in local regions of the bulb. This causes local heating of the bulb envelope and interferes with the rapid start-up of the plasma as well as a uniform light output along it.

It is therefore an object of the invention to provide a microwave generated plasma light source which couples microwave energy to a plasma forming medium, and to the plasma which is created, in a highly efficient manner.

It is a further object of the invention to provide a light source in which substantially full light output is obtained a relatively short time after system turn-on.

It is still a further object of the invention to provide an apparatus which avoids resonance effects.

It is still a further object of the invention to provide an apparatus which couples microwave energy in a controlled and uniform power deposition along the length of the bulb.

It is still a further object of the invention to provide an apparatus wherein the components and particularly the bulb can operate under full power conditions for long periods of time, without substantial degradation of performance.

The above objects are accomplished by providing a microwave generated plasma light source utilizing a longitudinally extending non-resonant microwave chamber which surrounds and encloses a longitudinally extending plasma forming medium containing tube. The non-resonant chamber has rectangular coupling slots therein which are oriented with their long dimensions perpendicular to the length of the plasma tube. This provides for highly efficient coupling of the microwave power to the tube as, unlike the generally used slot couplers from waveguide to coaxial line, it provides an electric field component in the axial direction of the tube.

Further, in order to couple enough power into the chamber to break down the gas and initiate the discharge in a short time, the coupling slots are azimuthally offset approximately 15° to 20° in opposite directions with respect to the longitudinal top center line of the chamber. This is believed to force higher order modes of microwave energy to propagate and also to minimize intercoupling between the magnetrons associated with the respective slots, particularly during the time interval before electrical breakdown of the plasma. The offsetting is advantageous because of where it places the maximum of the electric fields with respect to the bulb.

Further, the coupling slots are axially offset, i.e., located at different distances from the chamber ends to avoid resonance effects which can lead to hot areas along the plasma, and the frequencies of the two magnetrons are offset by a small amount in order to prevent intercoupling between the magnetrons during the time interval before a fully dissipative plasma load is created.

Further, it should be understood that while the invention is disclosed with respect to the above-described plasma light source, the microwave coupling techniques of the invention have general applicability and may be used to couple microwave energy to any highly dissipative load. Thus, the scope of the invention is to be limited only by the claims.

The invention will be better understood by referring to the drawings in which.

Figure 1:
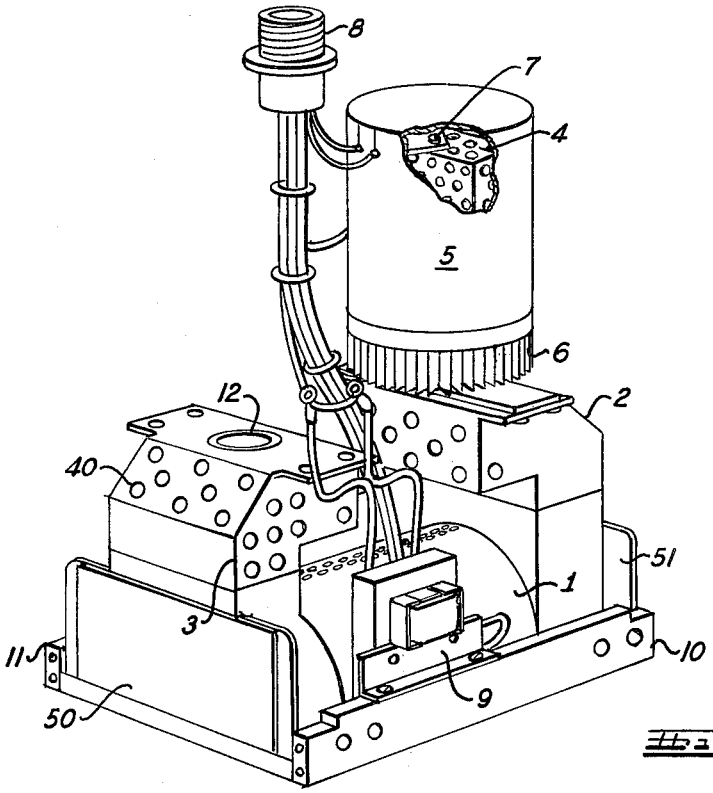
FIG. 1 is a perspective view of part of the light source of the invention.
Figure 5:
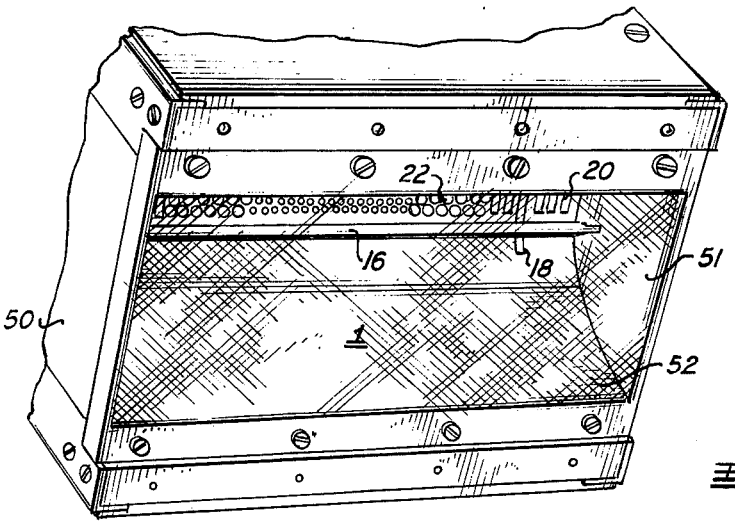
FIG. 5 is a perspective view of the light source looking towards the bottom thereof.

Referring to the drawings and particularly FIG. 5, the light source is seen to be comprised of longitudinally extending lamp bulb 16 which is disposed in the longitudinally extending non-resonant microwave chamber comprised of elliptically shaped reflector 1, metallic end plates 50 and 51, and mesh screen 52. The lamp bulb is located at or approximately at the focus of the ellipse and microwave power is generated by two magnetrons, each of which is mounted near a respective end of the chamber. Referring to FIG. 1, right hand end magnetron 4 having cooling fins 6 is shown. The magnetrons are mounted so that the microwave energy generated thereby is fed to waveguide launchers 2 and 3. The magnetrons may be mounted so that the domes thereof fit into the top openings in the waveguide launchers, one of which is shown at 12.

The magnetrons have cylindrical members 5 and 13 disposed therearound to direct cooling air onto the magnetrons. Additionally, the waveguides have cooling holes 40 disposed therein.

Figure 3:
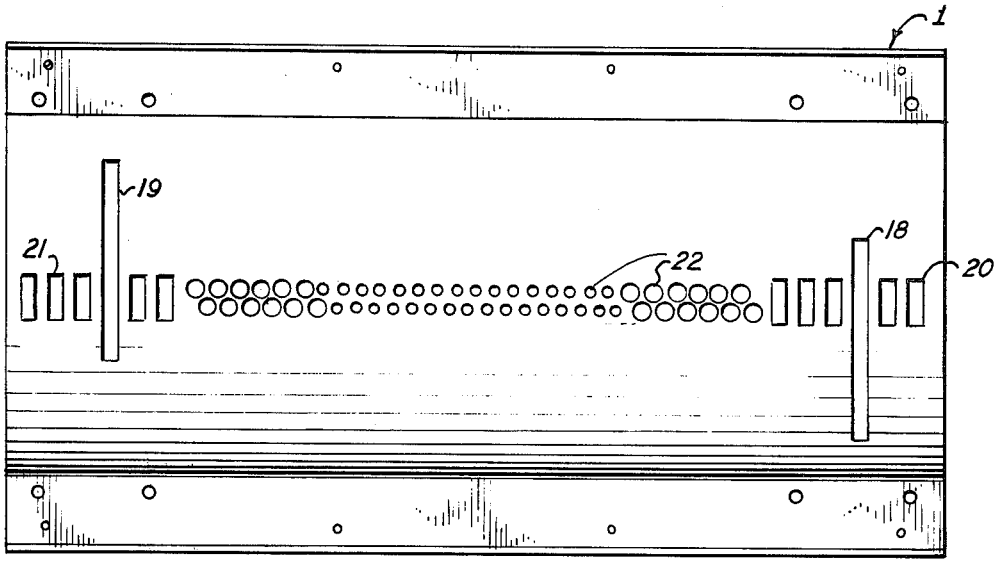
FIG. 3 is a plane view of the reflector of the light source, which is also a part of the non-resonant microwave chamber of the invention.
Figure 4:
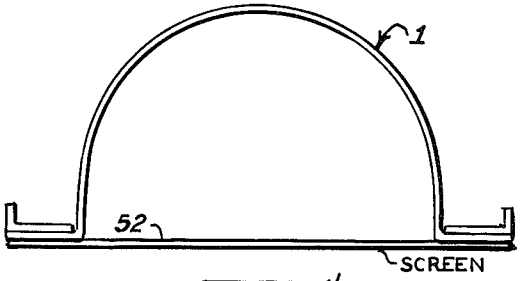
FIG. 4 is an end view of the reflector.

As shown most clearly in FIG. 3, the top part of the microwave chamber reflector 1 has coupling slots 18 and 19 disposed therein. The orientation and positioning of these slots is highly significant to the present invention, as will be discussed. Further, chamber portion 1 has cooling slots 20 and 21 and cooling holes 22 disposed therein. Waveguide sections 2 and 3 are elliptically cut out at their bottoms so as to fit over the reflector 1 over an area covering at least the coupling slots.

Figure 2:
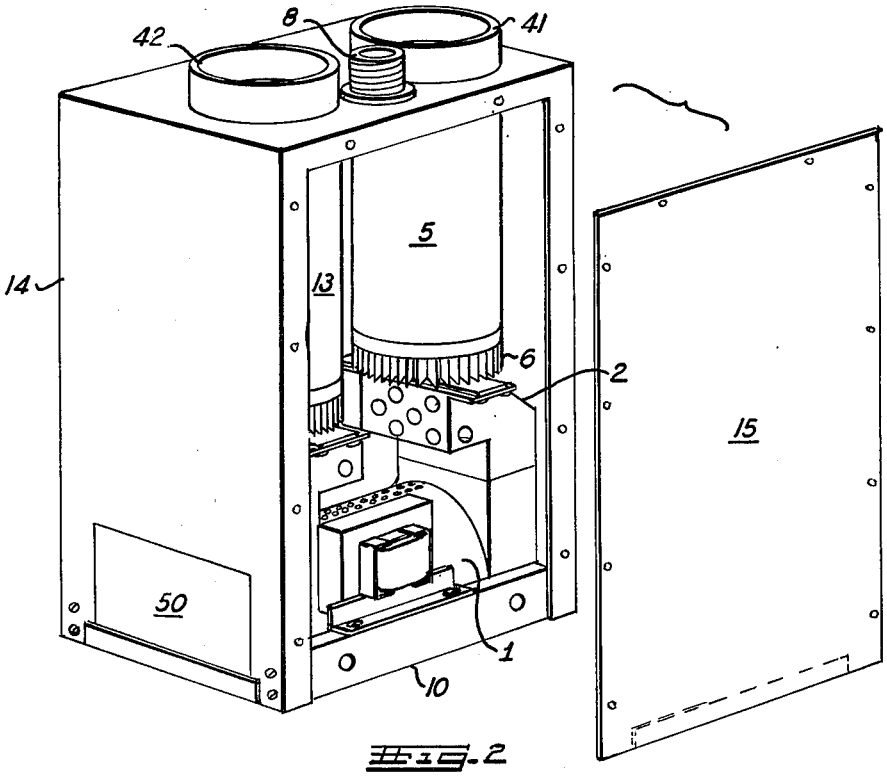
FIG. 2 is a perspective view of the light source mounted in its cabinet with one side thereof removed.

Wires from electrical connector 8 are connected to the high voltage inputs of the magnetrons and to filament transformer 9, the secondary of which is connected to the filaments of the magnetrons. The entire apparatus is mounted in cabinet 14, 15 by any mechanical means, well known to those skilled in the art, so that the reflector and mesh are at the bottom of the cabinet as shown in FIG. 2. Cabinet 14, 15 has round openings or ports 41 and 42 in the top thereof and these openings are mated or connected with cylinders 5 and 13. Electrical connector 8 is also mounted at the top of the cabinet.

In the operation of the apparatus, electrical power is fed to connector 8 from an appropriate power supply, not shown, and cooling air is fed to openings or ports 41 and 42. The cooling air flows down through cylindrical members 5 and 13 to cool the magnetrons and further flows into the area between the cylindrical members into holes 40 of waveguide sections 2 and 3. The lamp itself is cooled through cooling slots 20, 21 and cooling holes 22 in the microwave chamber.

The microwave chamber comprised of reflecting member 1, reflecting end walls 50 and 51, and mesh 52 is a non-resonant cavity whose dimensions are arranged to reduce the efficient propagation of the microwave radiation employed until the plasma forming medium is energized and becomes a plasma, which changes the nature of the load. As indicated above, the main reason for avoiding any dimensions in the chamber which are resonant with the microwave fields employed, is to prevent standing waves and regions of high local fields in the plasma.

Also, with a non-resonant chamber, when no dissipative load is inside or, in the case of the plasma load, before sufficient ionization has taken place, very little microwave power is coupled through the slots into the chamber. This reduces the leakage of microwaves from the chamber to the outside where they could present a safety hazard. Further, if the chamber were resonant, coupling between the microwave power sources, through the coupling slots and the chamber would be increased and such intercoupling is deleterious on the performance of the microwave sources.

In the case where the dissipative load is a plasma lamp tube, there is further significance in using a non-resonant chamber because the mesh wall utilized must be very fine to permit maximum light to escape. If the chamber were resonant, field energy would fill it before the plasma were activated and the fields created would be associated with wall currents which, in turn, might damage the screen. In the arrangement of the present invention, when the plasma is activated, the field energy is concentrated between the slot couplers, on the top of the reflector, and the plasma-filled tube. As a result, it is reduced in the vicinity of the screen. Thus, the lamp has been designed in such a way that currents are reduced in the mesh, either when the lamp is on or off.

The load in the system must be sufficiently dissipative to absorb the microwave power over dimensions comparable to the bulb length or, more precisely, power from one coupling slot must be absorbed over distances comparable to the interslot spacing. When this occurs, the plasma load acts as part of a dissipative or lossy transmission line which conducts the microwave field energy away from the coupling slot.

To achieve this, there must exist a good match between the microwave power produced at the sources, and the dissipative capacity of the load. For example, a preferred embodiment of the present invention employs two 1,500 Watt magnetron power sources and a 10 inches long bulb, and in this case the plasma load must be able to dissipate approximately 300 Watts per linear inch along the bulb as heat and radiation. To accomplish this a quartz tube of 4 to 8 mm bore is filled with a ball of mercury between approximately 5 and 10 mm in diameter and argon gas at 5 to 15 Torr pressure.

In a preferred embodiment of the invention, it has been found that a satisfactory level of intensity and axial uniformity in the emitted light is produced through the use of two separate microwave sources and coupling slots separated by 8 inches on each 10 inches long chamber. The light is found to fall off from each of the two coupling slots independently, approximately exponentially with axial distance. This behavior is expected for propagation down a lossy transmission line. The exponential decay length can be adjusted by varying the plasma parameters to be about 6 inches so that the overlapped absorption of the two slot patterns leads to a relatively uniform axial absorption.

When a properly chosen dissipative load is in position, the system can best be seen as a two-conductor highly dissipative transmission line. In the case of the plasma bulb, it is best regarded as a wire comprised of the plasma cylinder located above a conducting plane approximated by the region of the elliptical cross-section conductor which is between the bulb and the microwave sources. An alternative description is as a two-wire transmission line in which the second wire exists only as axial image currents in the elliptical cross-section conductor. Yet another description is as a coaxial transmission line with a non-circular outer conductor cross-section and an inner conductor which is offset. All of the descriptions are roughly equivalent, the uniqueness of the transmission line in each case being that one of the conductors is highly dissipative.

As shown in FIG. 3, coupling slots 18 and 19 are oriented perpendicular to the longitudinal direction of the lamp tube, which has been found to provide the most efficient coupling of the microwave energy to the plasma. While it has been common in the art to use slot couplers from waveguide to coaxial line, the slots are generally oriented in such a way as to produce a TEM mode (similar to an $H_{11}$ mode) with roughly circular magnetic field lines about the inner conductor (all as seen in cross-section) and radial electric fields. We have found effective coupling to the plasma lamp, however, only when the resonant slots are oriented with their long dimension perpendicular to the length of the plasma tube because this produces an electric field component in the axial dimension (as in an $E_{01}$ mode).

As indicated above, such a coupling scheme provides a highly efficient means to couple energy to any load comparable in dissipation to the plasma. Further, the transmission line nature of the load section means that the tuning of the coupling in the present system is accomplished geometrically by the disclosed design of the coupling slots and positioning of the plasma load. In the embodiment disclosed, extremely low power reflection, corresponding to VSWR values of below 2 to 1 was obtained without the need for any separate microwave tuning components or loads, which is very important from a practical and economic point of view.

While orienting the slots perpendicular to the longitudinal direction of the lamp tube provides for efficient coupling of microwave energy, the relative locations of the slots on the chamber has been found to be extremely important in satisfying other and related performance criteria.

We have found that offsetting the slots azimuthally around the chamber ensures that enough power is coupled to the lamp tube prior to the establishment of a dissipative plasma load to break down the gas and initiate the discharge within a matter of a few seconds. This is believed to force higher modes of microwaves having strong axial electric fields along the bulb length, to propagate.

Further, we have found that displacing the two slots azimuthally by about 15° to 20° from the central plane in opposite senses minimizes intercoupling between the slots and hence between the magnetrons, particularly during the time interval before the fully dissipative plasma load is established.

In order to minimize resonant effects, each of the slots is located at a different distance from one of the chamber ends. Thus, in the preferred embodiment, the center of one slot is approximately 0.90 inch from the end nearest it, while the other is 1.15 inches from its end. The choice of slot width and length as well as the design of waveguide sections 2 and 3 may be determined by well understood principles of microwave engineering to provide maximum coupling and minimum reflected power.

It is found that this offset spacing diminishes the physical length of the regions of lowest power loading absorption during the start-up phase, and in conjunction with the >15 Mhz separation between magnetrons, leads to a rapid start-up of 2–6 seconds. The offset slots are also found to reduce hot spots on the bulb envelope during full power operation and as a result to increase the lifetime of the bulbs. Offsetting the slots, axially, in this manner, is also very effective at reducing the cross coupling between the two magnetrons.

The same beneficial advantages can be obtained by inserting a U-shaped copper wire attached to the top of the reflector. By careful positioning, this wire can produce the same results. It may be constructed of any electrically conducting material. It acts as a capacitive load on the transmission line which decouples the transmission of energy from one side of the lamp to the other.

According to a further improvement of the present invention, the frequencies of the two microwave power generating means are offset by a small amount to prevent intercoupling between them. In the preferred embodiment, two magnetrons of nominal 2450 Mhz are used which have measured outputs which are separated by approximately 15 Mhz or more from one another. If two magnetrons of much closer frequencies are used, intercoupling between them occurs during the time interval before a fully dissipative plasma load is created, causing resonant effects, which produces alternate regions of intense discharge and weak discharge along the length of the bulb. The cooling air blowing on the weakly coupled region condenses the mercury and prevents it from vaporizing and establishing good coupling. This inhomogeneity makes the time delay for plasma creation overly long and results in a less favorable final plasma.

While we have disclosed and described the preferred embodiment of our invention, we wish it understood that we do not intend to be restricted solely thereto, but that we do intend to include all embodiments thereof which would be apparent to one skilled in the art and which come within the spirit and scope of our invention.

We claim:

1. An apparatus for efficiently coupling microwave energy to a load which becomes highly dissipative upon absorbing microwave energy, comprising, a longitudinally extending non-resonant microwave chamber, a longitudinally extending load which becomes highly dissipative upon absorbing microwave energy disposed in said chamber in the longitudinal direction, a pair of microwave energy generating means, said chamber having a pair of coupling slots therein, said slots being parallel to each other and disposed with their long dimensions perpendicular to said longitudinal direction, and means for coupling microwave energy from each of said generating means to a respective coupling slot.

2. The apparatus of claim 1 wherein said slots are rectangular.

3. The apparatus of claim 1 wherein said load is a plasma forming medium containing tube.

4. The apparatus of claim 3 wherein said chamber is curved in the direction perpendicular to said longitudinal direction and is symmetrical with respect to a longitudinally extending top center line, said slots being azimuthally offset with respect to said center line.

5. The apparatus of claim 4 wherein part of each slot overlies said center line.

6. The apparatus of claim 5 wherein each slot is azimuthally offset 15° to 20° from said center line.

7. The apparatus of claim 5 wherein said slots are located relative near respective ends of said chamber but wherein each slot is located at a different distance from the end near it.

8. The apparatus of claim 5 wherein the frequencies of said pair of generating means are intentionally offset from each other by a small amount.

9. The apparatus of claim 8 where said amount is in the range of 15 to 40 Mhz.

10. The apparatus of claim 7 wherein the frequencies of said generating means are intentionally offset from each other by a small amount.

11. The apparatus of claim 1 wherein said chamber is comprised of a first longitudinally extending curved reflecting member which is opaque to microwaves but is light reflective on its inside surface for reflecting light emitted by said tube and a second longitudinally extending plane member joined to said curved reflecting member along the bottom of said reflecting member to form said chamber, said second member being substantially transparent to said emitted light, whereby light emitted along the entire length of said tube, is reflected as a sheet of light by said reflecting member through said transparent member and out of said chamber.

12. The apparatus of claim 5 wherein said chamber is comprised of a first longitudinally extending curved reflecting member which is opaque to microwaves but is light reflective on its inside surface for reflecting light emitted by said tube and a second longitudinally extending plane member joined to said curved reflecting member along the bottom of said reflecting member to form said chamber, said second member being substantially transparent to said emitted light, whereby light emitted along the entire length of said tube, is reflected as a sheet of light by said reflecting member through said transparent member and out of said chamber.

13. The apparatus of claim 11 wherein said curved reflecting member is elliptically shaped.

* * * * *